United States Patent [19]

Bramsiepe et al.

[11] Patent Number: 5,069,091

[45] Date of Patent: Dec. 3, 1991

[54] SCREWDRIVER WITH PIVOTAL HANDLE

[75] Inventors: Holger Bramsiepe, Essen; Matthias Ocklenburg, Wuppertal, both of Fed. Rep. of Germany

[73] Assignee: Firma Robert Schroder, Wuppertal, Fed. Rep. of Germany

[21] Appl. No.: 553,782

[22] Filed: Jul. 13, 1990

[30] Foreign Application Priority Data

Sep. 7, 1989 [DE] Fed. Rep. of Germany ... 8910673[U]

[51] Int. Cl.[5] ..... B25G 1/00

[52] U.S. Cl. ..... 81/177.7; 81/177.9; 81/177.5; 81/60; 81/436

[58] Field of Search ..... 81/177.7, 177.8, 177.9, 81/177.2, 177.5, 60, 59.1–59.3, 436, 29–33

[56] References Cited

U.S. PATENT DOCUMENTS 4,170,909 10/1979 Wagner ..... 81/177.7 X 4,825,734 5/1989 Schwalbe et al. ..... 81/177.7 X

*Primary Examiner*—D. S. Meislin

*Attorney, Agent, or Firm*—Herbert Dubno; Andrew Wilford

[57] ABSTRACT

A handle for a screwdriver-type tool rotatable about a tool axis has a front handle portion having a front end adapted to carry the tool and a rear end formed with a pivot centered on an axis transverse to the tool axis and spaced by a predetermined axial distance from the front-portion front end. A rear handle portion is mounted on the pivot on the front handle portion and is displaceable between a normal-use position generally centered on and extending along the tool axis and a high-torque position extending transverse to the tool axis. The portions have a combined axial length in the normal use position equal to less than twice the overall axial length of the front handle portion.

8 Claims, 2 Drawing Sheets

SCREWDRIVER WITH PIVOTAL HANDLE

FIELD OF THE INVENTION

The present invention relates to a tool like a screwdriver. More particularly this invention concerns a handle for such a tool which can move between a position centered on the rotation axis of the tool and a position crosswise of this axis.

BACKGROUND OF THE INVENTION

It is known to provide a screwdriver, nut driver, or the like that in use is rotated about a longitudinal tool axis with a handle that can be moved from a normal-duty position centered on and extending along the tool axis to a high-torque position extending generally transverse to the axis. Thus for standard light-duty use the handle is in the normal-duty position so that it can be rotated virtually continuously by holding the handle in the finger tips. When substantially more force must be brought to bear, the handle is put in the high-torque position so the user can grip it in his or her fist and apply quite some angular force to the nut or screw being worked on.

A main problem with such a tool is that in the high-torque position it is necessary to switch hands or to take the tool out of contact with the workpiece to rotate the workpiece through a full 360°. It is also necessary to provide a clumsy locking nut or the like to hold the two handle parts in line with each other for standard straight-line use. This locking arrangement is an annoyance during use of the tool.

OBJECTS OF THE INVENTION

It is therefore an object of the present invention to provide an improved screwdriver-type tool with a pivotal handle.

Another object is the provision of such an improved screwdriver-type tool with a pivotal handle which overcomes the above-given disadvantages, that is which is easy to use even in the high-torque position and which does not have a handle-locking mechanism that gets in the user's way.

SUMMARY OF THE INVENTION

A handle for a screwdriver-type tool rotatable about an axis has a front portion having a front end adapted to carry the tool and a rear end formed with a pivot centered on an axis transverse to the tool axis and spaced by a predetermined axial distance from the front-portion front end. A rear handle portion is mounted on the pivot on the front portion and displaceable between a normal-use position generally centered on and extending along the tool axis and a high-torque position extending transverse to the tool axis. According to this invention the portions have a combined axial length in the normal use position equal to less than twice the overall axial length of the front handle portion, that is the distance between the front end of the front handle portion and the rear end of the rear handle portion. This axial length is somewhat greater than the axial distance between the transverse axis and the front-portion front end.

Thus with this system in the high-torque position the user's hand will still engage around the front handle portion. This stabilizes this part and makes a positive locking of the parts in the high-torque position unnecessary. It is therefore possible to relatively easily flip the rear portion back and forth as the tool is rotated. Furthermore in the normal-use position the user's hand grips both parts of the handle so that it is not necessary to provide a separate locking arrangement to hold them in line in this position.

According to another feature of this invention the rear portion has a front part projecting in the normal-use position axially forward a predetermined distance past the axis and the rear portion has an overall axial length equal to about three times the predetermined distance the front part projects past the axis. This gives a sort of T-shape to the handle in the high-torque position for maximum force transmission. Furthermore the front part is formed by a pair of legs flanking the rear end of the front handle portion and the handle further has a pivot pin extending along the traverse axis through the rear end of the front handle portion and the rear portion. The front part of the rear portion and the rear end of the front handle portion are formed with a pair of oppositely open concave seats opening symmetrically flanking a plane defined by the axes. The result is an extremely comfortable, ergonomically speaking, tool to use.

In accordance with features of this invention in the high-torque position the rear portion extends to between 60° and 70° to the tool axis. Furthermore a latch is provided for releasably retaining the portions in the normal-use position. This latch comprises a ball displaceable in one of the portions parallel to the tool axis in the normal-use position, the other portion being formed with a seat in which the ball is received in the normal-use position and a spring braced axially between the ball and the one portion.

DESCRIPTION OF THE DRAWING

The above and other objects, features, and advantages will become more readily apparent from the following, reference being made to the accompanying drawing in which.

SPECIFIC DESCRIPTION

Figure 1:
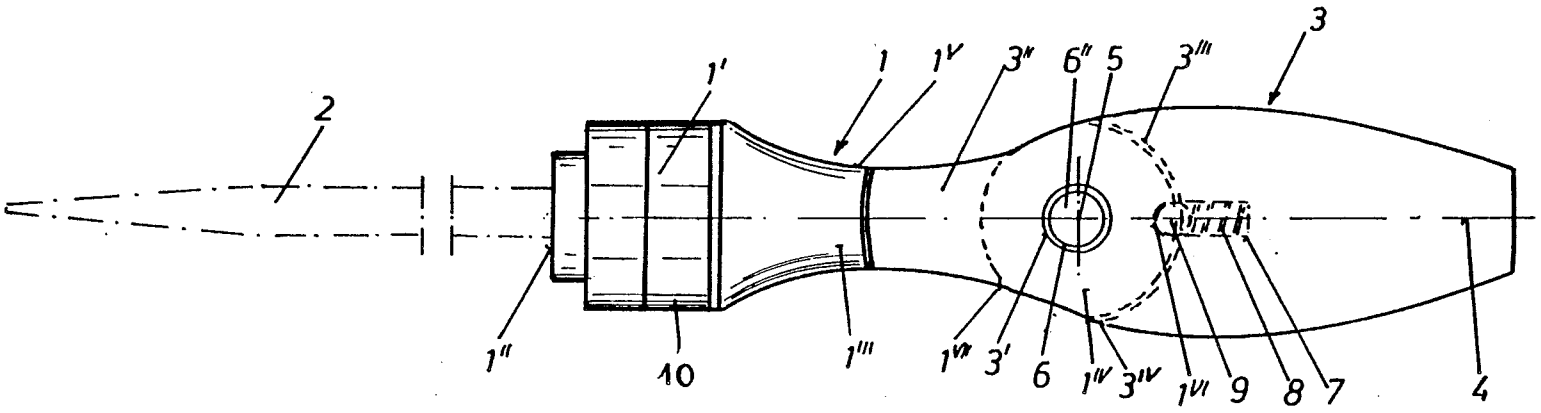
FIGS. 1 and 2 are side views of the tool taken 90° offset from each other.
Figure 2:
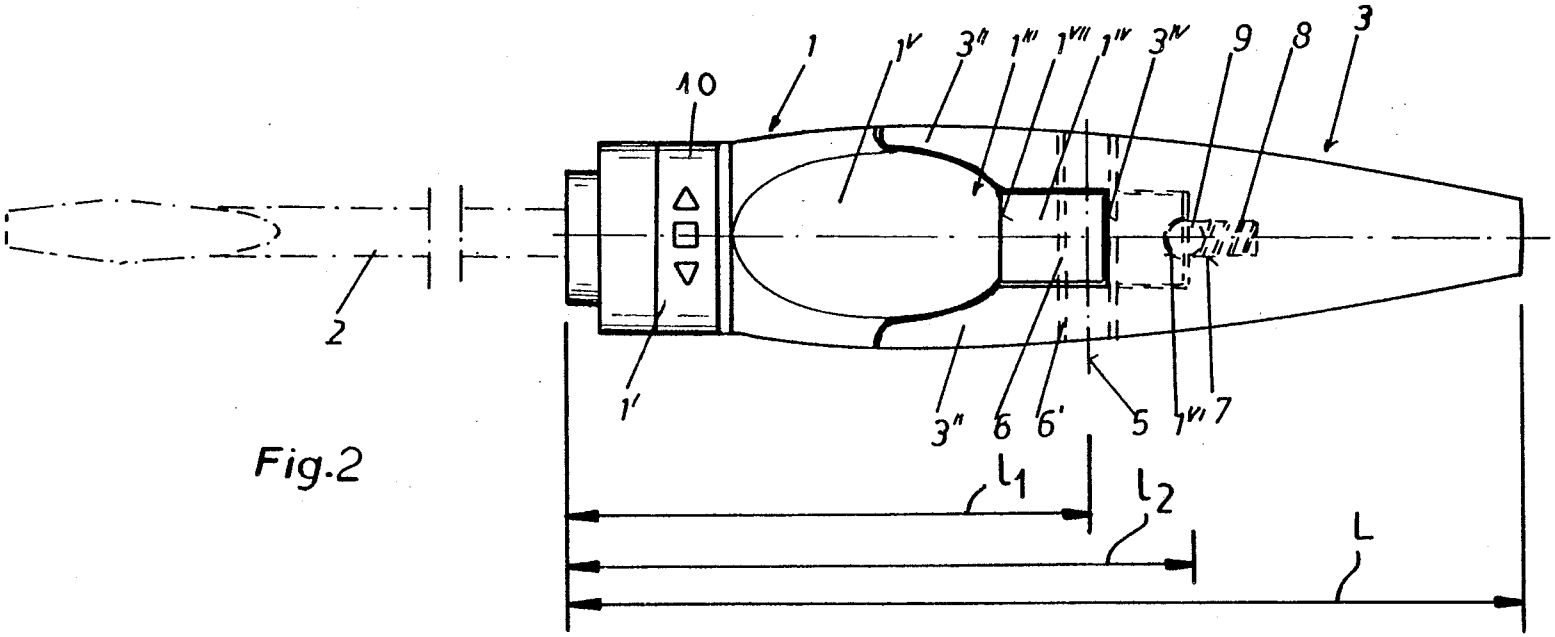

As seen in FIGS. 1 and 2 a screwdriver according to this invention has a handle 1, 3 formed by a front handle portion 1 and a rear handle portion 3, with a tool 2, here a screwdriver blade, carried in the front handle portion 1. The two portions 1 and 3 are relatively displaceable between a normal-use position seen also in FIG. 3 and a high-torque position seen in FIG. 4. In the normal-use position the portions 1 and 3 are centered on a common tool axis 4 that is also the axis of the blade 2. A ratchet mechanism operated by a ring 10 is provided for allowing the blade 2 to rotate freely in one direction or the other and for locking this blade 2 against all such rotation. Both portions 1 and 3 are made of a durable synthetic resin.

The tool 2 is mounted in a socket $1^{II}$ in a front part $1^{I}$ of the front handle portion 1 and this portion 1 has a rear part $1^{III}$ which extends backward to form an eye $1^{IV}$ centered on an axis 5. A pivot sleeve 6 is fitted tightly into the eye $1^{IV}$ and has ends $6^{I}$ that project along the axis 5, which is perpendicular to the axis 4, from the rear part $1^{III}$. The rear part $1^{III}$ forms forward of the axis 5 a pair of concave seats $1^{V}$ that symmetrically flank a plane defined by the intersecting axes 4 and 5. According to this invention the handle 1, 3 has an overall axial length L and the axis 5 is spaced by a distance $l_1$ equal to slightly more than L/2 from the front end of the handle 1, 3. The front handle portion 1 has an overall length $l_2$ equal to somewhat more than L/2 and also greater than $l_1$.

The rear portion 3 is formed with a transverse hole $3^I$ into which the sleeve 6 fits to form a pivot joint and has two axially forwardly projecting legs $3^{II}$ that symmetrically flank the plane defined by the axes 4 and 5 and that also in the normal-use position flank the seats $1^V$. Furthermore the portion 3 forms a forwardly open part-cylindrical surface $3^{III}$ complementary to the eye $1^{IV}$ and centered on the axis 5 that fits over the eye $1^{IV}$.

The two handle portions 1 and 3 are retained in the normal use position by a latch system comprised by a ball 9 and compression spring 8 seated in a blind bore 7 centered on the axis 4 in the normal-use position in the portion 3. The eye $1^{IV}$ is formed with an axially rearwardly open pocket or seat $1^{VI}$ that receives this ball 9 in the normal-use position.

Figure 3:
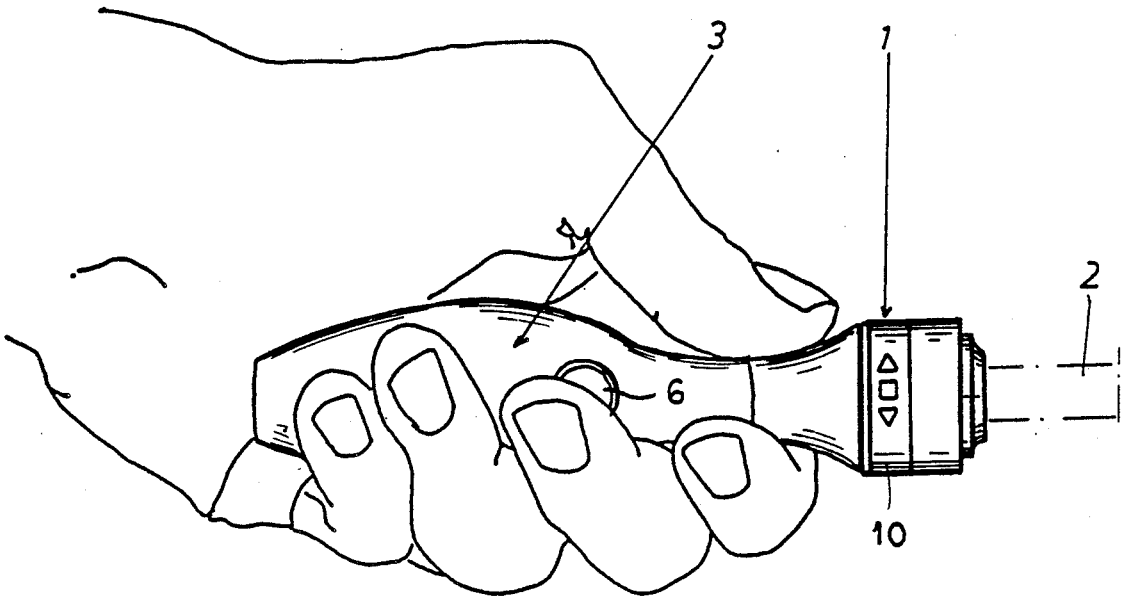
FIGS. 3 and 4 are side views of the tool in use in the normal-duty and high-torque positions, respectively.

For normal light- and medium-duty use as seen in FIGS. 1 through 3 the two handle portions 1 and 3 are coaxial. This allows the entire device to be rotated rather quickly about the axis 4.

Figure 4:
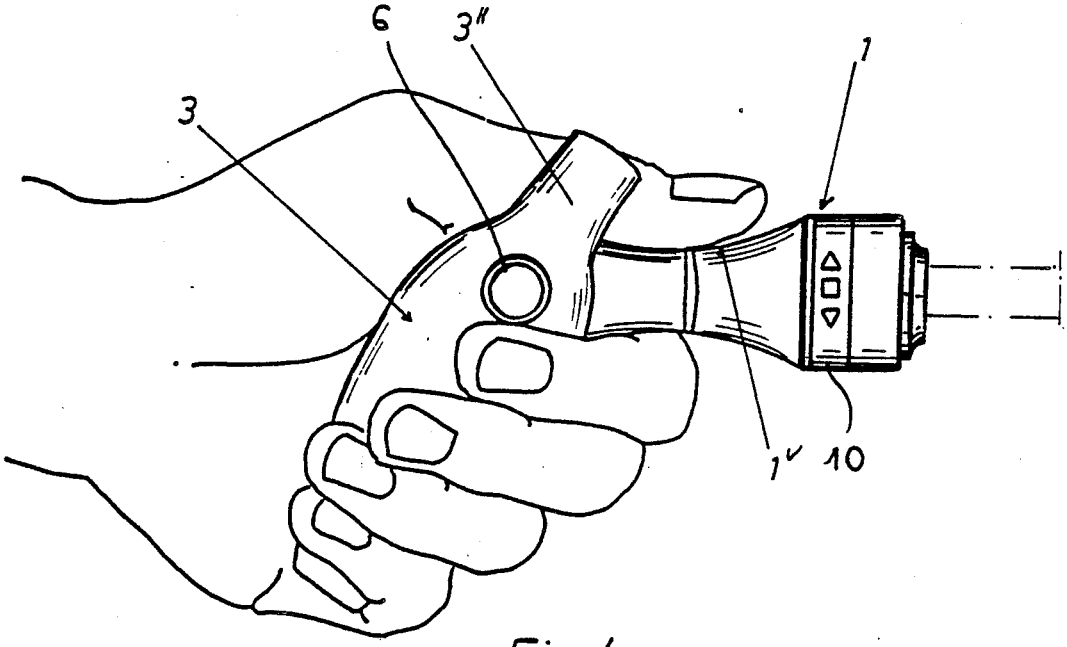

For high-torque use, however, the rear portion 3 is swung over some 60° to 70° into the position of FIG. 4 so that the user can grab the rear portion 3 rearward of the axis 4 with his or her fingers while putting his or her thumb on one of the seats $1^V$ and between the two legs $3^{II}$ of the rear portion 3. This ensures a very sure purchase and allows considerable torque to be brought to bear while keeping the tool 2 on center. In addition in this high-torque position it is possible to insert a rod in the sleeve 6 to bring even more angular force to bear.

In the high-torque position an edge $3^{IV}$ of the surface $3^{III}$ comes to engage an edge $1^{VII}$ where the eye $1^{IV}$ joins one of the seats $1^V$. This positive contact makes the high-torque position quite stable.

The ratchet mechanism operated by the ring 10 can be of the type described in U.S. Pat. Nos. 1,878,053 or 2,685,355. Rotation of this ring 10 to one end position gives right-hand ratcheting and rotating to the opposite end position gives left-hand ratcheting. This device uses internal balls that act spragfashion along with appropriate ramp surfaces inside the structure to permit the desired one-way movement. Such one-way ratcheting action is particularly useful in the high-torque position.

The tool according to this invention can be used not only in the angular end positions of the rear handle portion 3, but in intermediate positions, for instance with the portion 3 extending at 20° to the axis 4. This has the advantage that it is possible to work in a limited space while still bringing to bear more torque than would be possible in the straight-line normal-use position.

We claim:

1. A handle for a screwdriver-type tool rotatable about an axis, the handle comprising:

a front handle portion having a front end adapted to carry the tool and a rear end formed with a pivot centered on an axis transverse to the tool axis and spaced by a predetermined axial distance from the front-portion front end; and a rear portion mounted on the pivot on the front handle portion and displaceable between a normal-use position generally centered on and extending along the tool axis and a high-torque position extending transverse to the tool axis, the portions having a combined axial length in the normal-use position equal to less than twice the overall axial length of the front handle portion, the rear portion having a front part projecting in the normal-use position axially forward a predetermined distance past the transverse axis and formed by a pair of legs flanking the rear end of the front handle portion, the legs projecting in the high-torque position laterally past the front portion and forming in the high-torque position a laterally open seat, and an overall axial length equal to about three times the predetermined distance the front part projects past the transverse axis; and a pivot pin extending along the traverse axis through the rear end of the front handle portion and the rear portion, whereby when in the high-torque position the fingers of the user engage around the rear portion and the thumb of the user lies in the seat, between the legs of the front part, and against the front portion.

2. The handle defined in claim 1 wherein in the high-torque position the rear portion extends between about 60° and 70° to the tool axis.

3. The handle defined in claim 1, further comprising latch means for releasably retaining the portions in the normal-use position.

4. The handle defined in claim 3 wherein the latch means includes a ball displaceable in one of the portions parallel to the tool axis in the normal-use position, the other portion being formed with a seat in which the ball is received in the normal-use position; and a spring braced axially between the ball and the one portion.

5. The handle defined in claim 1 wherein the portions are formed of a synthetic resin.

6. The handle defined in claim 1, further comprising:

a socket carried on the front portion and adapted to releasably hold the tool; and ratchet means between the socket and the front portion for controlled bidirectional ratcheting of the socket on the front portion.

7. A handle for a screwdriver-type tool rotatable about an axis, the handle comprising:

a front handle portion having a front end adapted to carry the tool and a rear end formed with a pivot centered on an axis transverse to the tool axis and spaced by a predetermined axial distance from the front-portion front end;

a rear portion mounted on the pivot on the front handle portion and displaceable between a normal-use position generally centered on and extending along the tool axis and a high-torque position extending transverse to the tool axis, the portions having a combined axial length in the normal-use position equal to less than twice the overall axial length of the front handle portion, the rear portion having a front part projecting in the normal-use position axially forward a predetermined distance past the transverse axis and formed by a pair of legs flanking the rear end of the front handle portion, and an overall axial length equal to about three times the predetermined distance the front part projects past the transverse axis; and a pivot pin extending along the traverse axis through the rear end of the front handle portion and the rear portion, the front part of the rear portion and the rear end of the front handle portion being formed with a pair of oppositely open concave seats opening symmetrically flanking a plane defined by the axes.

8. The handle defined in claim 7 wherein the pivot pin is a tubular sleeve, whereby a rod can be inserted into the sleeve for increasing the torque applicable by the tool.

* * * * *